United States Patent [19]

Cook

[11] Patent Number: 4,619,743

[45] Date of Patent: Oct. 28, 1986

[54] ELECTROLYTIC METHOD FOR REDUCING OXALIC ACID TO A PRODUCT

[75] Inventor: Ronald L. Cook, Aurora, Ill.

[73] Assignee: Texaco Inc., White Plains, N.Y.

[21] Appl. No.: 755,528

[22] Filed: Jul. 16, 1985

[51] Int. Cl.[4] ..... C25B 3/04

[52] U.S. Cl. ..... 204/77; 204/76; 204/237; 204/263

[58] Field of Search ..... 204/75, 76, 77, 237, 204/263

[56] References Cited

U.S. PATENT DOCUMENTS

| | | | |
|---|---|---|---|
| 3,779,876 | 12/1973 | Michelet | 204/76 |
| 4,517,062 | 5/1985 | Barber | 204/77 |
| 4,543,173 | 9/1985 | Noding | 204/263 |
| 4,560,450 | 12/1985 | Morduchowitz et al. | 204/75 |
| 4,564,432 | 1/1986 | Nagai et al. | 204/237 |

FOREIGN PATENT DOCUMENTS

| | | | |
|---|---|---|---|
| 0757106 | 4/1971 | Belgium | 204/77 |

*Primary Examiner*—Howard S. Williams

*Attorney, Agent, or Firm*—Robert A. Kulason; James J. O'Loughlin; Ronald G. Gillespie

[57] ABSTRACT

Apparatus for reducing oxalic acid to a product includes a cell. A separator which separates the cell into two chambers; a catholyte chamber and an anolyte chamber. Each chamber has an inlet and an outlet. A porous cathode having a catalyst is arranged within the catholyte chamber so that an aqueous catholyte, having ammonium chloride, entering the inlet of the catholyte chamber will pass through the cathode. A porous anode is arranged within the anolyte section so that an aqueous electrolyte, having ammonium chloride, entering the inlet of the anolyte section will pass through the anode and exit through the outlet of anolyte section. A source provides the catholyte which is a mixture of oxalic acid and an aqueous electrolyte, having ammonium chloride, to the inlet of the catholyte chamber while another source provides the electrolyte to the inlet of the anolyte chamber. A d.c. voltage is provided between the cathode and the anode so as to cooperate in the reduction of oxalic acid within the porous cathode to a product which exits the catholyte chamber by way of its outlet.

6 Claims, 1 Drawing Figure

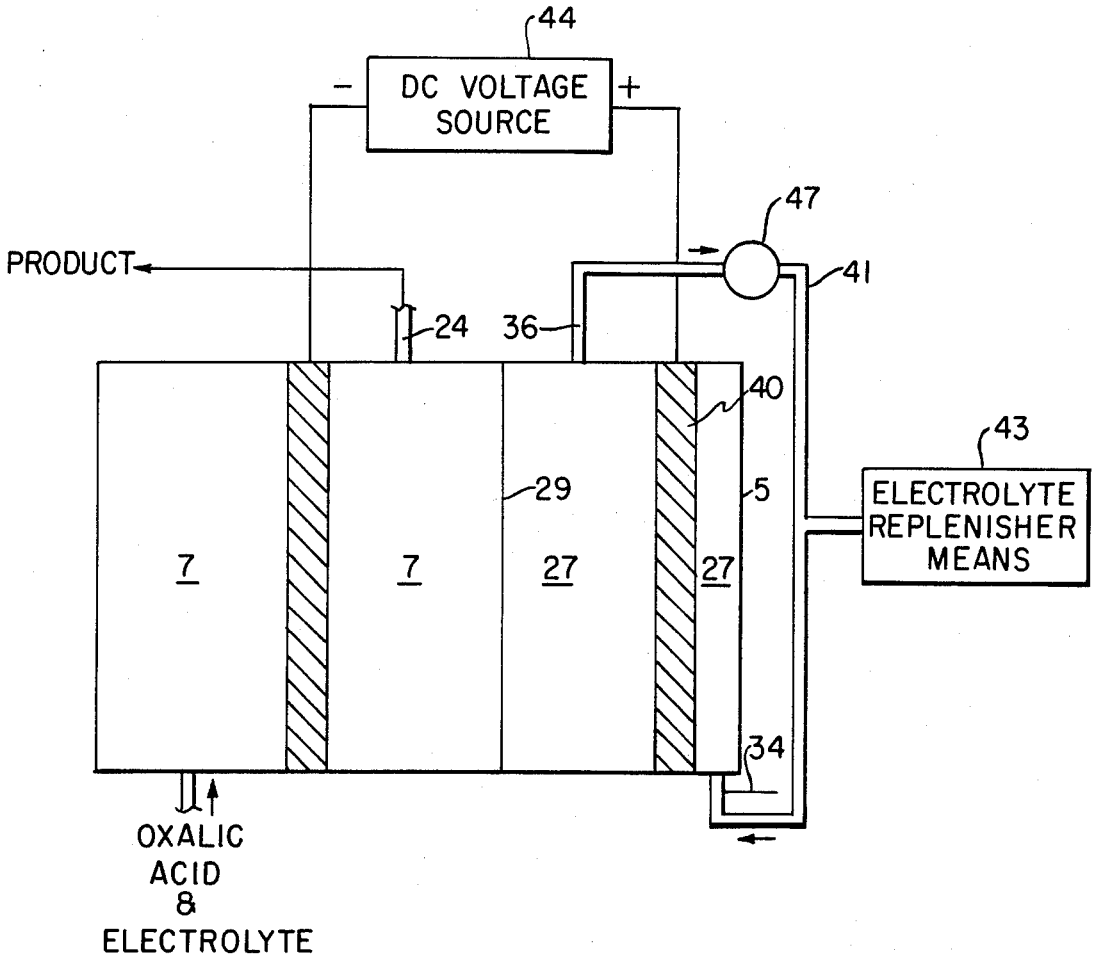
44
DC VOLTAGE SOURCE
−
+
47
PRODUCT
41
24
36
40
43
29
5
ELECTROLYTE REPLENISHER MEANS
7
7
27
27
34
OXALIC ACID & ELECTROLYTE

ELECTROLYTIC METHOD FOR REDUCING OXALIC ACID TO A PRODUCT

BACKGROUND OF THE INVENTION

Field of the Invention

The present invention relates to electrochemical processes in general and, more particularly, to apparatus and the method for reducing oxalic acid to provide a product.

SUMMARY OF THE INVENTION

Apparatus for reducing oxalic acid to a product includes a cell. A separator which separates the cell into two chambers; a catholyte chamber and an anolyte chamber. Each chamber has an inlet and an outlet. A porous cathode having a catalyst is arranged within the catholyte chamber so that an aqueous catholyte, having ammonium chloride, entering the inlet of the catholyte chamber will pass through the cathode. A porous anode is arranged within the anolyte section so that an aqueous electrolyte, having ammonium chloride, entering the inlet of the anolyte section will pass through the anode and exit through the outlet of anolyte section. A source provides the catholyte which is a mixture of oxalic acid and an aqueous electrolyte, having ammonium chloride, to the inlet of the catholyte chamber while another source provides the electrolyte to the inlet of the anolyte chamber. A d.c. voltage is provided between the cathode and the anode so as to cooperate in the reduction of oxalic acid within the porous cathode to a product which exits the catholyte chamber by way of its outlet.

The objects and advantages of the invention will be described more fully hereinafter from a consideration of the detailed description which follows, taken together with the accompanying drawings wherein one embodiment of the invention is illustrated by way of example. It is to be expressly understood, however, that the drawing is for illustration purposes only and is for illustration purposes only and is not to be construed as defining the limits of the invention.

BRIEF DESCRIPTION OF THE DRAWING

The FIGURE is a partial schematic and a partial cutaway drawing of apparatus for reducing oxalic acid to provide a product in accordance with one embodiment of the present invention.

DESCRIPTION OF THE INVENTION

With reference to the FIGURE, there is shown vessel 5 having a catholyte chamber 7 receiving an oxalic acid and aqueous electrolyte mixture through an inlet 8. A porous cathode 10 is arranged within catholyte chamber 7 so that the oxalic acid-electrolyte mixture passes through it. Catholyte chamber 7 also has an outlet 24 from which a product exits. An anolyte chamber 27 is separated from catholyte chamber 8 by a separator 29. Separator 29 allows transfer of ions while keeping the catholyte and anolyte separate. Anolyte chamber 27 has an inlet 34 and an outlet 36. A porous anode 40 is arranged in anolyte chamber 27 in a manner so that an aqueous electrolyte entering througuh inlet 34 passes through anode 40 and leaves via outlet 36 to be returned to inlet 34 via a line 41. An electrolyte replenisher means 43 replenishes the aqueous electrolyte in line 41.

A d.c. voltage source 44 has its positive terminal connected to anode 40 and its negative terminal connected to cathode 10 so as to provide a direct current voltage across cathode 10 and anode 40.

Cathode 10 is made of a porous carbon with a catalyst of either rhenium or copper deposited on it while anode 40 is a porous dimensionally stable anode such as a titanium substrate with rhenium or copper as a catalyst. With an aqueous electrolyte including anywhere from 0.1 molar of ammonium chloride to a solution saturated with ammonium chloride, the product provided is glycoaldehyde.

The glycoaldehyde, if so desired, may be further processed using a second cell arrangement as previously described for cell 5 with the difference being that cathode 10 in the second arrangement has mercury as a catalyst. The product produced from glycoaldehyde is ethylene glycol.

If ethylene glycol is desired, it may be produced directly from oxalic acid by providing cathode 10 with both rhenium or copper and mercury as catalysts. However, the rhenium or copper and mercury must have their own discrete sites on cathode 10 and are not applied homogeneously to cathode 10.

The present invention as hereinbefore described electrochemically reduces oxalic acid to either glycoaldehyde or ethylene glycol.

What is claimed is:

1. A method for reducing oxalic acid to a product comprising the steps of:

separating a catholyte and an aqueous anolyte, having ammonium chloride, in a manner so that electrons can pass between them, mixing oxalic acid with an aqueous electrolyte having ammonium chloride to provide the catholyte, passiang the catholyte through a porous cathode having a catalyst, passing the anolyte through a porous anode, and providing a d.c. voltage across the cathode and the anode so as to cooperate in the reduction of the oxalic acid within the cathode to a product.

2. A method as described in claim 1 in which the quantity of ammonium chloride in the electrolyte ranges from 0.1 molar to saturation.

3. A method as described in claim 2 in which the cathode is made from porous carbon.

4. A method as described in claim 3 in which the catalyst on the cathode is rhenium and the product is glycoaldehyde.

5. A method as described in claim 3 in which the catalyst on the cathode is copper and the product is glycoaldehyde.

6. A method as described in claim 3 in which the cathode has discrete sites of rhenium and mercury as catalysts and the product is ethylene glycol.

* * * * *